US005106221A

United States Patent [19]

Diot et al.

[11] Patent Number: 5,106,221

[45] Date of Patent: Apr. 21, 1992

[54] DEVICE FOR PACKAGING AND APPLYING A PRODUCT CONTAINED IN A FLEXIBLE, LEAKTIGHT TUBE

[75] Inventors: Gaël Diot, Bougival; Daniel Goujon, Brion, both of France

[73] Assignee: Plastiques RG & Gael Diot, France

[21] Appl. No.: 717,031

[22] Filed: Jun. 18, 1991

[30] Foreign Application Priority Data

Jun. 26, 1990 [FR] France ..... 90 08302

[51] Int. Cl.[5] ..... B05C 17/00

[52] U.S. Cl. ..... 401/132; 401/261; 401/266

[58] Field of Search ..... 401/132, 261, 266

[56] References Cited

U.S. PATENT DOCUMENTS 2,930,063 3/1960 Stull ..... 401/132

FOREIGN PATENT DOCUMENTS 616020 7/1935 Fed. Rep. of Germany ..... 401/261
2139922 1/1973 France .
2239292 2/1975 France .
2345224 11/1977 France ..... 401/266

*Primary Examiner*—Steven A. Bratlie
*Attorney, Agent, or Firm*—Wall and Roehrig

[57] ABSTRACT

A package and applicator for dispensing a product from a flexible closed tube having a weakened zone in one end is shown. A one-piece application unit is attached by a U-shaped portion whose legs are connected to the edges of the tube at the weakened zone end. The unit has a flexible spatula disposed facing the weakened zone and a cogged wheel for breaking the weakened zone. The wheel is attached on one side to said zone and on the other side to the inner face of the U-shaped base portion. Rotation of the cogged wheel opens the weakened zone and detaches it from the base portion, with the consequence that pressure on the flexible tube will deliver the product onto the spatula for application.

7 Claims, 2 Drawing Sheets

DEVICE FOR PACKAGING AND APPLYING A PRODUCT CONTAINED IN A FLEXIBLE, LEAKTIGHT TUBE

The invention relates to a device for packaging and applying a product contained in a flexible, leaktight tube closed at both ends; it concerns more particularly a one-shot device for applying a predetermined amount of a cosmetic or pharmaceutical cream to the skin.

BACKGROUND OF THE INVENTION

In the description and claims the word "product" denotes not only a conventional cream or paste but also a similar preparation in semiliquid, gel or ointment form. Although in the remainder of the description the invention is described more particularly in respect of its application to the pharmaceutical or cosmetic industries, it may also find other fields of use, for example in the foodstuffs industry.

It is well known to apply a cream to the skin for cosmetic or pharmaceutical purposes. As a rule the user places a determined amount in the palm of the hand or on the fingers and spreads it over the appropriate area. Although it has been in general use for a long time, this method has the disadvantage of soiling the wound or the area requiring treatment through the use of the hands or fingers, and of not permitting accurate dosage of the amount applied. Furthermore, in many cases it is sufficient simply to apply a strictly determined but adequate amount of product, even if the latter is on sale only in substantial quantities. This entails needlessly high expense through failure to use the entire contents of the tube.

In addition, in the case of repeated use of a multishot container in tube form the risk of bacterial contamination of the contents arises as soon as the container is opened, since the product can then come into contact with a finger or hand or even with the wound or skin surface needing treatment.

The invention obviates these disadvantages. It relates to a device enabling a product, for example one for cosmetic or pharmaceutical use, to be easily applied without soiling either the wound or the area to be treated or the fingers or hand. It relates to a device of the type in question which permits application without direct contact between the fingers or hand and the area concerned. It also relates to a device of the type in question which contains an accurate dose and is intended for use for one application only.

SUMMARY OF THE INVENTION

This device for packaging and applying a product contained in a flexible tube which is closed at both ends, and one of whose ends has a weakened zone from which the product can escape after this zone has been broken, is characterised in that, at the end where the weakened zone is provided, the tube is attached to a one-piece application unit integrally moulded with the tube and comprising respectively:

a U-shaped portion whose branches are attached to the edges of said end;

a flexible spatula which is disposed on the outer face of the base connecting the branches of the U and which faces the weakened zone;

a means for breaking the weakened zone, said means being attached on one side to said zone and on the other side to the inner face of the connecting base, in such a manner that through the action of this breaking means the weakened zone and therefore the tube opening are freed and the breaking means is detached, with the consequence that pressure on the flexible tube, which has thus been opened, delivers the product onto the spatula and enables the product then to be applied.

In other words, the invention relates to a device for applying a product contained in a tube attached to a spatula and provided with a means enabling the tube to be pierced in line with the spatula, so that through the action of simple pressure applied to said flexible tube the product is delivered onto the flexible spatula, thus enabling it to be easily applied without previously bringing the product into contact with any part of the body other than the area which is to be treated.

As already stated, in a preferred embodiment the device is for use for one application only, so that it can be conveniently used for regenerative cosmetic or pharmaceutical applications.

In another embodiment the flexible tube may consist of two coaxial elementary tubes each containing a determined component, and with the aid of the device of the invention these two components are released, by the breaking action, onto the spatula, where they are mixed at the precise moment of use.

Advantageously, in practice:

the breaking means is composed of a cogged wheel disposed at right angles to the longitudinal axis of the tube, with its centre temporarily attached on one side to the weakened zone and on the other side to the centre of the inner part of the portion connecting the branches of the U, so that through the action of a slight rotation of said wheel about its axis the weakened zone is ruptured, whereupon the wheel is detached;

the two connecting zones of the cogged wheel are provided with rupture starting zones;

the non-aggressive spatula has the shape of a flexible flipper widening outwards from the portion connecting the branches of the U; it is advantageous for one face of this spatula to be slightly offset relative to the longitudinal axis of the tube and to the outlet aperture formed by the opened weakened zone; the spatula is advantageously also provided with a plurality of longitudinal grooves intended to facilitate the flow and the spreading of the product passing out of the tube;

the one-piece application unit is produced by moulding a plastics material, such as for example polyethylene or polypropylene;

the one-piece application unit may be common to two contiguous or, better still, coaxial tubes or compartments, thus making it possible to release their contents onto the spatula at the same moment and to mix these two contents in-situ when they are applied.

BRIEF DESCRIPTION OF THE DRAWINGS

The manner in which the invention may be put into practice and the advantages which derive therefrom will be more clearly apparent from the following exemplary embodiment, with the aid of the accompanying drawings.

DETAILED DESCRIPTION OF A PREFERRED EMBODIMENT

Figure 1:
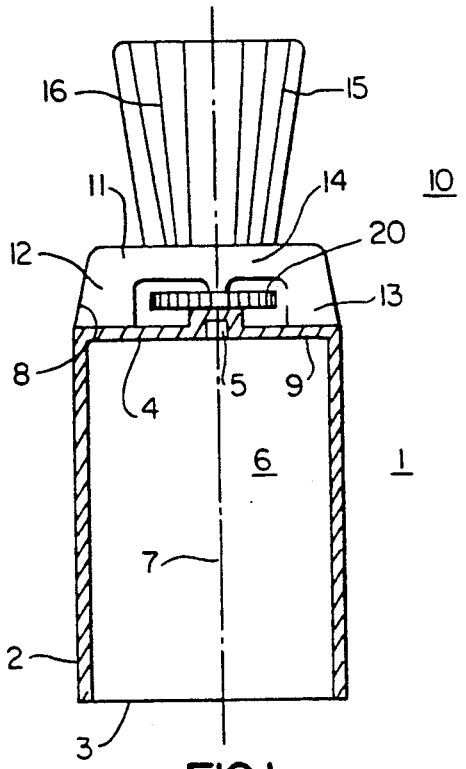
FIGS. 1, 2 and 3 show a device according to the invention, viewed respectively from the front, from the side and from above.
Figure 2:
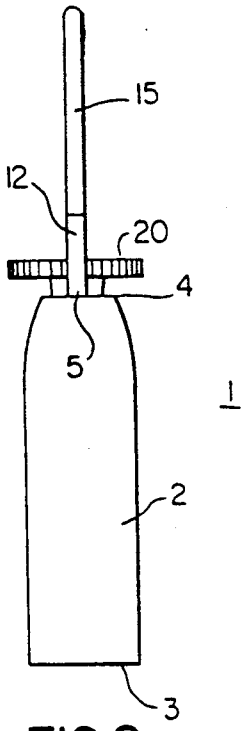
Figure 3:
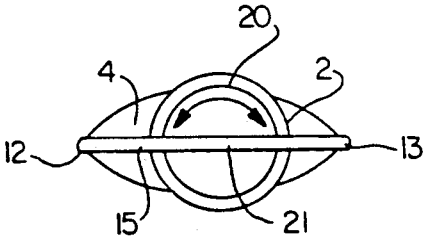

The device according to the invention, given the general reference 1, is produced in a single piece by moulding a plastics material (polyethylene, polypropylene). This device 1 comprises firstly a flexible tube 2 intended to receive a predetermined amount of product, for example a cream, and is closed at both ends 3 and 4, particularly by welding. The top end 4 has a weakened zone 5, through which the cream 6 can escape after rupture of this zone. The tube 2 and the device 1 have a common longitudinal axis 7. According to a first characteristic of the invention, said tube 2 is attached, at its end 4 which is provided with the weakened zone 5, to a one-piece unit 10 integrally moulded with the tube and comprising respectively:

firstly a U-shaped portion 11 whose two branches 12 and 13 are attached to the two edges 8, 9 of the end 4;

a spatula 15 which is disposed on the outer face of the base 14 connecting the branches 12, 13 of the U, and which faces the weakened zone 5.

This characteristic flexible, non-aggressive spatula 15 has the shape of a flipper widening outwards from the connecting portion 14. In a first embodiment this spatula 15 may be in alignment with the longitudinal axis 7 and the outlet aperture 5. In an advantageous embodiment (not illustrated) this spatula 15 is slightly offset relative to said longitudinal axis 7 of the tube 2 and to the outlet aperture 5. Similarly, the spatula 15 has a plurality of longitudinal grooves 16 which are regularly spaced and intended to facilitate the flow and the application of the cream 6 passing out of the tube 2.

The one-piece rupture unit comprises a cogged disc given the general reference 20 and disposed at right angles to the longitudinal axis 7 of the tube 2, the centre of said disc being temporarily connected on one side to the weakened zone 5 and on the other side to the centre 17 of the inner part of the portion 14 connecting the branches 12, 13 of the U. It will easily be understood (see FIGS. 1 and 5) that through the action of a slight rotation of this wheel 20 about its axis 7 the weakened zone 5 will be ruptured, and thereupon the wheel is detached (see FIG. 5) in order in this way to free the aperture 5 completely. In order to facilitate this rupturing of the wheel 20 and of the weakened zone 5, the connecting zones 17 and 5 of said wheel 20 are provided with integrally moulded rupture starting zones (not shown).

As already stated, the device of the invention in one piece and is produced direct by moulding.

Figure 4:
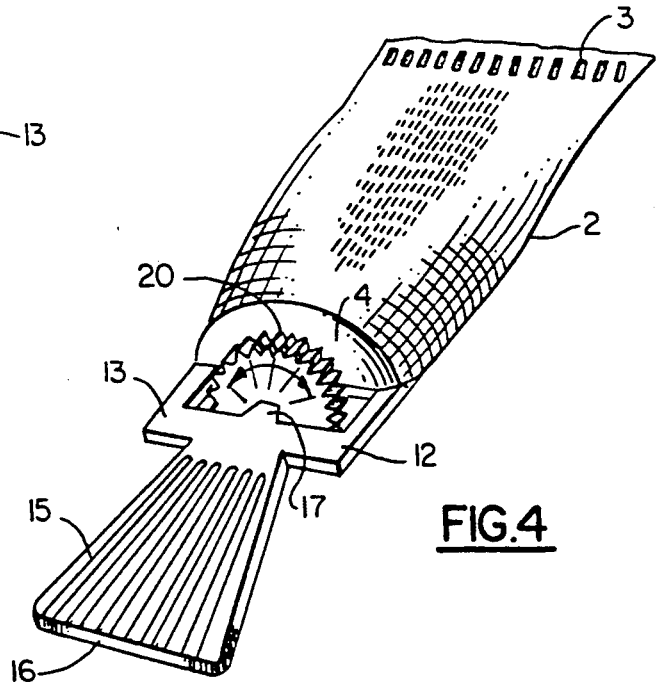
FIGS. 4, 5 and 6 show rough perspective views of a device of this kind, respectively in the closed position (FIG. 4), with the wheel detached (FIG. 5), and in the position of readiness for application (FIG. 6).

The tube is filled in a known manner with a predetermined amount of cream 6 and the open end 3 is welded. The device (see FIG. 4) is then ready for use.

Figure 5:
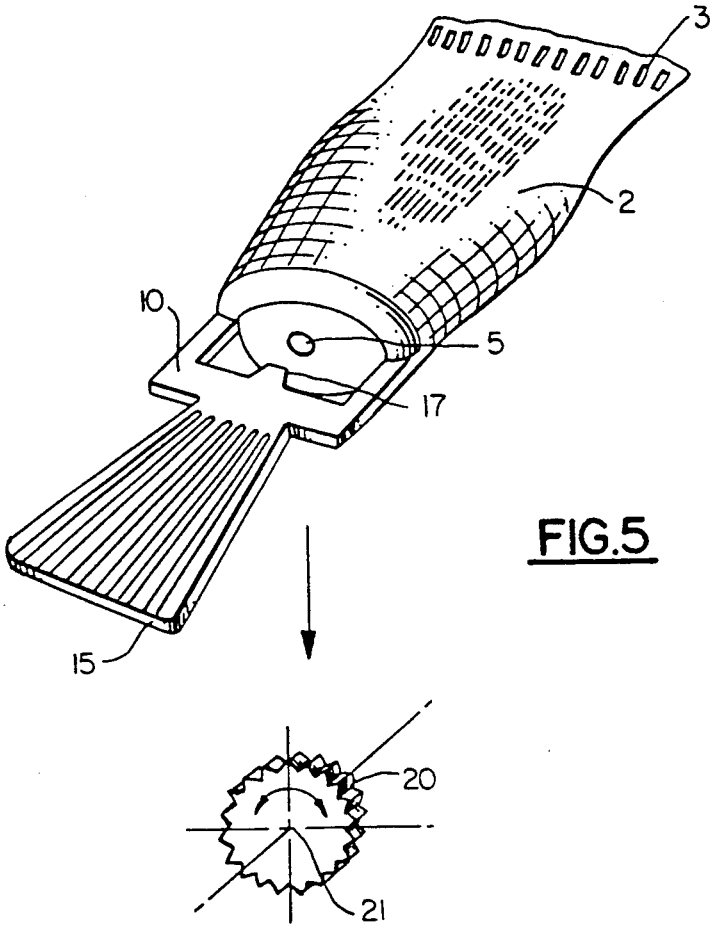

When the user wishes to apply the cream, the cogged wheel 20 is turned slightly with the fingers in order to detach it from the connecting portion 17 and thus to free the aperture 5 (FIG. 5).

Figure 6:
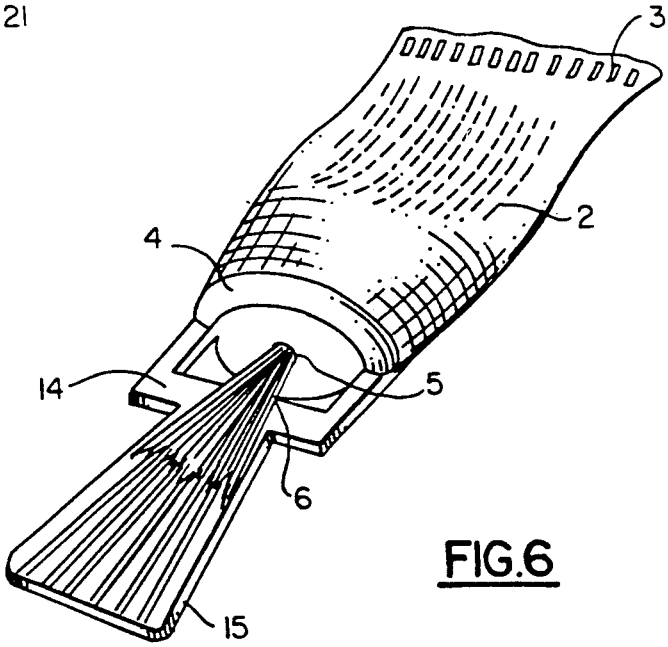

It will readily be understood that light pressure applied with the fingers to the tube 2 (see FIG. 6) will exert a thrust on the cream, which is thus propelled from the aperture 5 onto the spatula 15. The cream 6 is then ready for application without having come into contact with the hand or fingers.

In a second embodiment (not illustrated) the tube 2 is composed of two coaxial flexible containers each holding one of two components, which are intended to be mixed only when required for use. These two coaxial tubes are welded at their bases, which may be a common base, and have at their opposite end a weakened zone 5 which is common to the two tubes but is attached to the wheel 20. In this way, when said wheel 20 is broken off an detached, access is gained to each elementary tube. Through the action of light pressure, these two components are delivered onto the spatula 15, where they are mixed and, where applicable, interact to form a product ready for use.

As already stated, this device may have numerous applications, particularly in the cosmetic and pharmaceutical fields, particularly for cutaneous treatments, and also in the fields of foodstuffs or industry.

We claim:

1. A device for packaging and applying a product contained in a flexible tube, closed at both ends, one of said ends having a weakened zone from which the product can escape after this zone has been broken, which comprises:

a flexible tube closed at both ends;

a weakened zone formed in one end of said tube;

a one-piece application unit, integrally molded with the tube at the weakened zone end, having a U-shaped portion with a base joining two legs are attached to the edges of said weakened end;

a flexible spatula disposed on the outer face of the base connecting the legs of the U-shaped portion which faces the weakened zone;

means for breaking the weakened zone, said means being attached on one side to said zone and on the other side to the inner face of the connecting base, in such a manner that through the action of this breaking means the weakened zone and therefore the opening of the tube are freed and the breaking means is detached, so that pressure on the flexible tube, which has thus been opened, delivers the product onto the spatula and enables the product to be applied.

2. A device according to claim 1, wherein the breaking means includes a cogged wheel disposed at right angles to the longitudinal axis of the tube, with its center temporarily attached on one side to the weakened zone and on the other side to the center of the inner part of the U-shaped portion connecting the legs of the U, so that through rotation of said wheel about is axis the weakened zone is ruptured, and the wheel is detached.

3. A device according to claim 2, characterized in that the two connecting zones of the cogged wheel are provided with rupture starting zones.

4. A device according to claim 1 wherein the spatula has the shape of a flexible flipper widening outward from the portion connecting the two legs of the U, one of the faces of said spatula being slightly offset relative to the longitudinal axis of the tube and to the outlet aperture formed by the opened weakened zone, said spatula having in addition a plurality of longitudinal grooves for the flow and the spreading of the product passing out of the tube.

5. A device according to claim 1, wherein said one-piece application unit is produced by molding a plastics material consisting of polyethylene or polypropylene.

6. A device according to claim 1 wherein the flexible tube contains a predetermined quantity suitable for a single application of a cosmetic or pharmaceutical cream.

7. A device according to claim 1 wherein the one-piece application unit is common to two coaxial tubes.

* * * * *